United States Patent [19]

Kitazumi et al.

[11] Patent Number: 5,070,432

[45] Date of Patent: Dec. 3, 1991

[54] PROJECTOR-TYPE AUTOMOBILE HEADLAMP HAVING IMPROVED APPEARANCE

[75] Inventors: Satoshi Kitazumi; Katsuhisa Saito, both of Shizuoka, Japan

[73] Assignee: Koito Manufacturing Co., Ltd., Tokyo, Japan

[21] Appl. No.: 711,838

[22] Filed: Jun. 7, 1991

[30] Foreign Application Priority Data

Jun. 19, 1990 [JP] Japan ..... 2-158622

[51] Int. Cl.[5] ..... F21M 3/00

[52] U.S. Cl. ..... 362/61; 362/80; 362/298

[58] Field of Search ..... 362/61, 80, 298, 299, 362/300, 362

[56] References Cited

U.S. PATENT DOCUMENTS 4,677,532 6/1987 Peitz et al. ..... 362/61
4,727,458 2/1988 Droste et al. ..... 362/61
4,839,785 6/1989 Ohishi ..... 362/61
4,949,226 8/1990 Makita et al. ..... 362/61

*Primary Examiner*—Ira S. Lazarus
*Assistant Examiner*—Richard R. Cole
*Attorney, Agent, or Firm*—Sughrue, Mion, Zinn, Macpeak & Seas

[57] ABSTRACT

An automobile headlamp employing a projector-type lamp having an improved outer appearance. The headlamp includes a lamp body having a front opening closed by a front lens, covering said front opening, a reflective lamp cover disposed in the lamp body, and a projector lamp unit mounted in the lamp body. The projector lamp unit has a forward end portion extending through an opening in the lamp cover, with the outer surface of the forward end portion being a reflecting surface. With this structure, the gap between the projector lamp and the periphery of the lamp cover is rendered inconspicuous, and the headlamp appears deeper and more three dimensional.

7 Claims, 3 Drawing Sheets

PROJECTOR-TYPE AUTOMOBILE HEADLAMP HAVING IMPROVED APPEARANCE

BACKGROUND OF THE INVENTION

The present invention relates to a projector-type automobile headlamp employing a projector lamp unit.

Recently, there has come into common use projector-type headlamps using a projector lamp unit in which the output light beam of a light source (bulb) is passed through a projector lens, namely, a convex lens. This arrangement is advantageous due to the greater quantity of output light than in a reflector-type headlamp in which the output light beam of the light source is formed into a parallel light beam using a reflector.

As shown in FIG. 8, in a known headlamp of this general type, a projector lamp unit 3 is arranged in a lamp chamber S defined by a lamp body 1 and a lens 2. In FIG. 8, reference numeral 4 designates a projector lamp cover with a light reflecting surface 4*a*. The projector lamp cover 4 has an opening 5 into which the projector lens 3a of the projector lamp unit 3 is inserted.

In the case of the above-described conventional headlamp, the light reflecting surface 4*a* reflects external light, but the projector lens 3*a* scarcely reflects external light. Hence, when the lamp is turned on, an observer standing in front of the vehicle will see a relatively dark ring in the lamp; that is, the gap 6 between the periphery of the opening 5 and the projector lamp unit 3 appears as a dark ring, as shown by shading in FIG. 9. On the other hand, since the lamp cover 4 is substantially flush with the projector lens 3*a*, the lamp appears small in depth, or relatively flat, and thus is rather unattractive in appearance.

SUMMARY OF THE INVENTION

In view of the foregoing, an object of the invention is to provide an automobile headlamp employing a projector lamp unit which has an excellent external appearance with the area around the projector lamp unit improved in appearance.

The foregoing and other objects of the invention have been achieved by an automobile headlamp in which a projector lamp cover having a light reflecting surface is arranged in a lamp chamber defined by a lamp body and a lens, and a projector lamp unit is inserted into an opening formed in the lamp cover, in which, according to the invention, the projector lamp unit protrudes from the opening towards the lens, and the outer surface of a lens holder holding the projector lens of the projector lamp unit is a light reflecting surface.

In the headlamp of the invention, external light is reflected in the region of the lens holder of the projector lamp unit which protrudes from the opening formed in the lamp cover, whereby the gap between the projector lamp unit and the periphery of the opening of the lamp cover is made inconspicuous. In addition, because the lens holder of the projector lens protrudes beyond the light reflecting surface of the lamp cover, the headlamp appears deeper and more three-dimensional.

DESCRIPTION OF THE PREFERRED EMBODIMENTS

Preferred embodiments of the invention will now be described with reference to the accompanying drawings.

Figure 1:
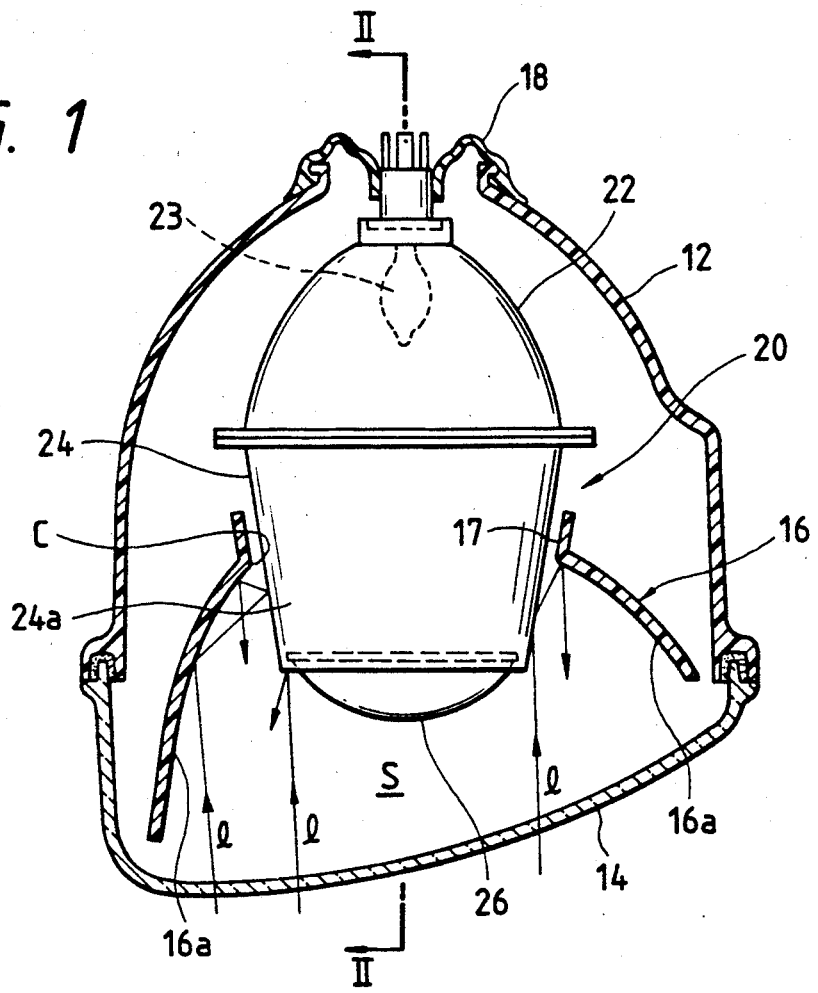
FIG. 1 is a horizontal sectional view of an automobile headlamp of a first embodiment of the invention.
Figure 2:
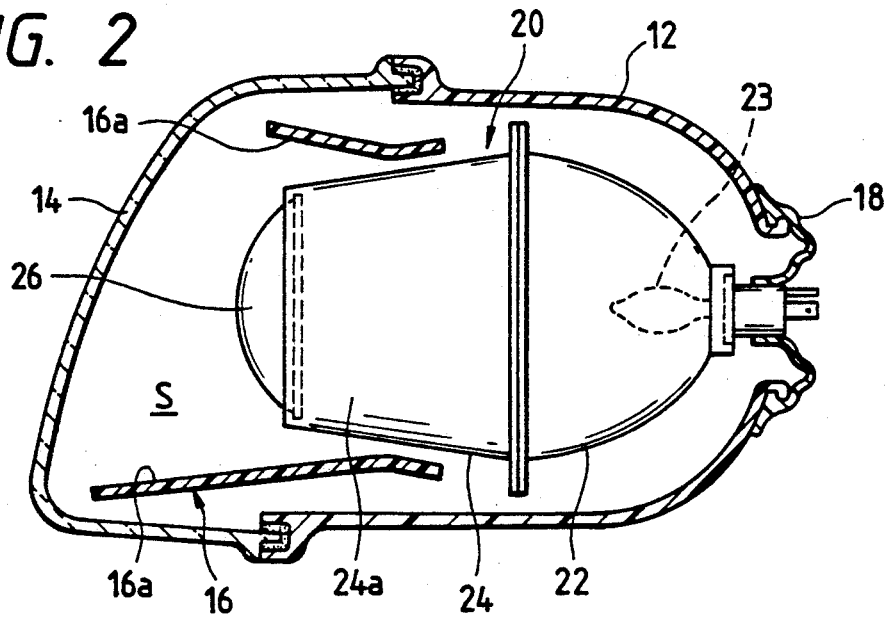
FIG. 2 is a vertical sectional view taken along a line II—II in FIG. 1.

FIGS. 1 and 2 shows a first embodiment of a headlamp of the invention. More specifically, FIG. 1 is a horizontal sectional view showing a projector-type automobile headlamp constructed in accordance with the teachings of the invention, and FIG. 2 is a vertical sectional view taken along a line II—II in FIG. 1.

In these figures, reference numeral 12 designates a container-shaped lamp body with a front opening in which a lens 14 is mounted. The lamp body 12 and the lens 14 define a lamp chamber S. In the lamp chamber S, a projector lamp cover 16 is supported on the lamp body 12. The lamp cover 16 spans substantially the entire lamp chamber S. A light reflecting surface 16*a* is formed on the front surface of the lamp cover 16 by a reflector coating. Hence, when the lamp is turned off, the light reflecting surface 16*a* reflects external light, thus making the lamp substantially the same in external appearance as a reflector-type headlamp. The lamp cover 16 has an opening 17 in which a projector lamp unit is inserted. In FIG. 1 and 2, reference numeral 18 designates a rubber cover which covers an opening formed in the rear end portion of the conically shaped lamp body 12.

The projector lamp unit 20 includes a reflector 22 a light bulb 23 mounted with its filament near the focal point of the reflector, and a cylindrical lens holder 24 integral with the reflector 22, the lens holder 24 surrounding a projector lens 26. The projector lamp unit 20 is arranged so that the front end portion of the lens holder 24 greatly protrudes from the opening 17 of the lamp cover 16 towards the lens 14. Generally, there is provided no lens step on the lens 14 at a portion facing the projector lens 26. A light-reflecting layer 24*a* is formed on the outer surface of the lens holder 24 by coating or plating, or the surface of the lens holder 24 of metal is made glossy to form the light reflecting surface 24*a*. Therefore, when the area around the projector lamp unit 20 is observed from the front, because external light is reflected from the light reflecting surface 16*a* of the lamp cover and from the light reflecting surface 24 of the lens holder (as indicated by arrows l in the drawing), the gap c between the projector lamp unit 20 and the periphery of the lamp cover opening 17 is totally inconspicuous. Furthermore, since much of the projector lamp unit 20 projects forwardly of the lamp cover 16, the projector lamp unit 20 and the light reflecting surface 16*a* of the lamp cover are partially shaded, whereby the lamp chamber appears deep and three-dimensional. Particularly when sunlight shines on the lens holder 24 of the projector lamp unit, the part of the lens holder 24 which is not struck by sunlight is accordingly shaded, whereby the lamp appears deeper and more three-dimensional.

Figure 3:
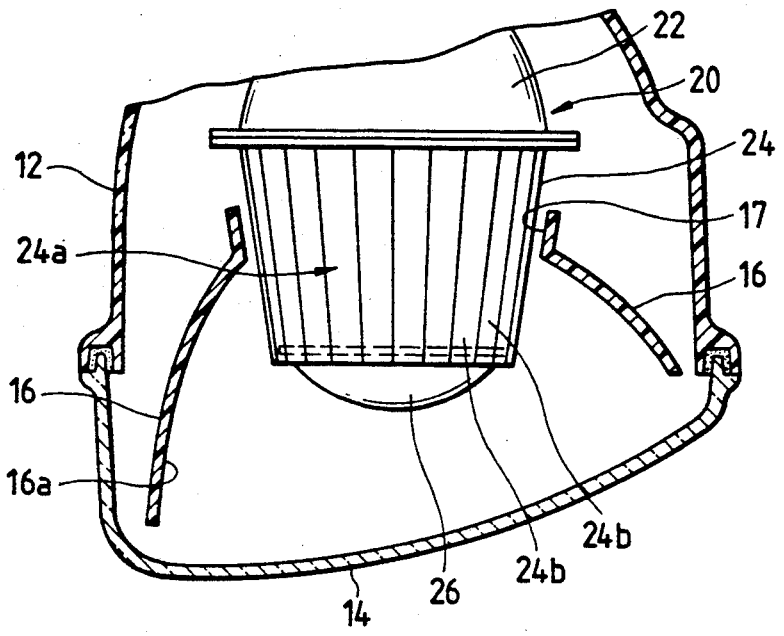
FIG. 3 is a horizontal sectional view of an automobile headlamp of a second embodiment of the invention.
Figure 5:
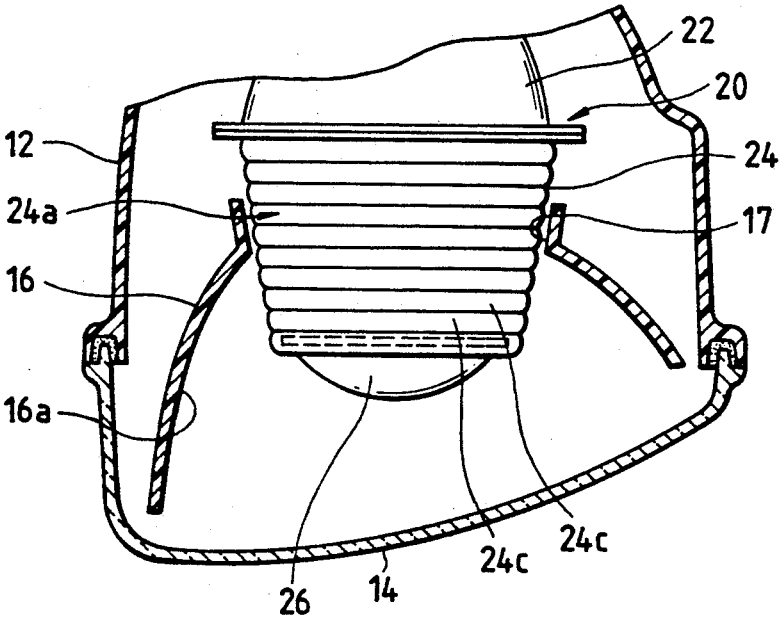
FIG. 5 is a horizontal sectional view showing an automobile headlamp of a third embodiment of the invention.

FIGS. 3 and 5 are horizontal sectional views showing headlamps of second and third embodiments of the invention, respectively. The second and third embodiments differ from the first embodiment in that an uneven pattern is formed on the outer surface of the lens holder.

Figure 4:
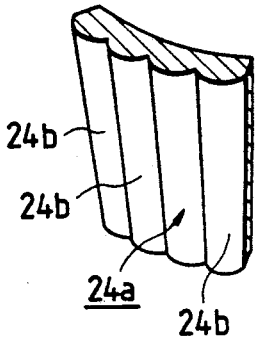
FIG. 4 is an enlarged diagram showing parts of protruding stripes formed on the outer cylindrical surface of a lens holder shown in FIG. 3.

In the second embodiment shown in FIG. 3, similarly as in the case of the above-described first embodiment, the outer surface of the lens holder 24 serves as a light reflecting surface 24. A number of cylindrical stripes 24*b* are formed side by side on the outer surface of the lens holder 24 in such a manner that they extend generally in the direction of the optical axis of the lens holder 24. FIG. 4 is an enlarged view showing some of the cylindrical stripes 24*b*.

Figure 6:
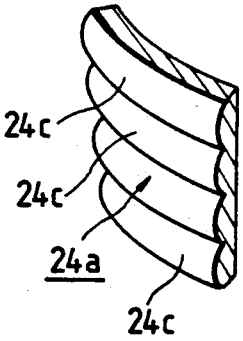
FIG. 6 is an enlarged diagram showing parts of protruding stripes formed on the outer cylindrical surface of a lens holder shown in FIG. 5.

In the third embodiment shown in FIG. 5, a number of cylindrical stripes 24*c* are formed side by side on the outer surface of the lens holder 24 in such a manner that they extend perpendicular to the axis of the lens holder. FIG. 6 is an enlarged view showing some of the cylindrical stripes 24*c*.

In the second and third embodiments of the invention, similarly as in the first embodiment described above, the gap c between the projector lamp unit 20 and the opening 17 is not seen at all. Moreover, the shadow formed on the lens holder is darker than in the first embodiment, and accordingly the lamp appears deeper and more three-dimensional.

Figure 7:
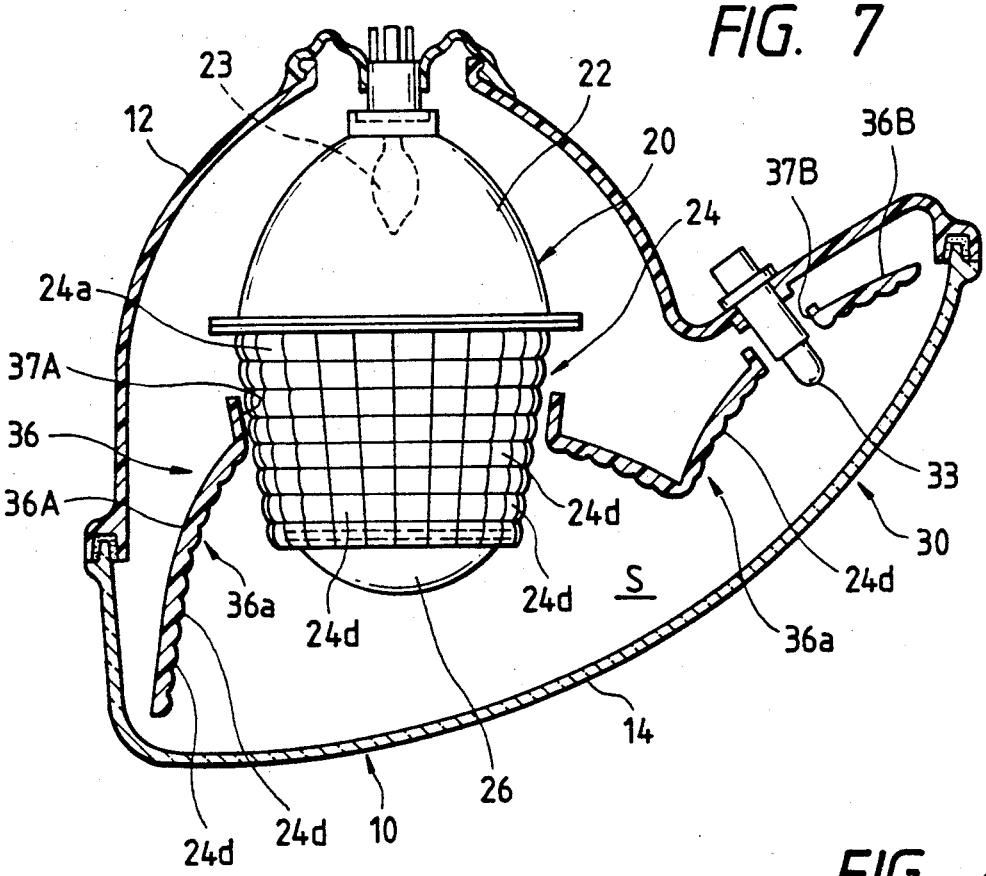
FIG. 7 is a horizontal sectional diagram showing an automobile headlamp of a fourth embodiment of the invention.
Figure 8:
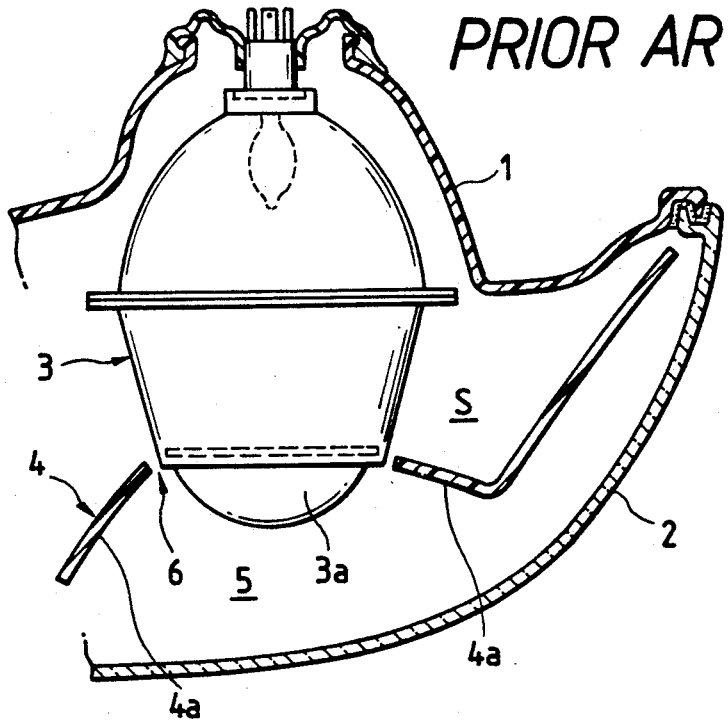
FIG. 8 PRIOR ART
FIG. 8 is a horizontal sectional view of a conventional automobile headlamp.
Figure 9:
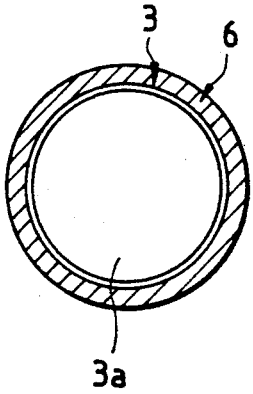
FIG. 9 is a diagram for a description of a shadow formed around the projector lamp unit of the conventional automobile headlamp.

FIG. 7 is a horizontal sectional view showing an automobile headlamp integral with a side lamp, which constitutes a fourth embodiment of the invention.

In the fourth embodiment, a side lamp 30 such as a clearance lamp or a turn signal lamp is provided beside a headlamp 10; that is, the headlamp 10 and the side lamp 30 form one unit. The lamp cover 36 having a light reflecting surface 36*a*, which is provided in the lamp chamber S, oxtends laterally; that is, the lamp cover 36 includes a projector lamp cover portion 36A and a side lamp bulb cover portion 36B which extends from the projector lamp cover portion 36A. The projector lamp cover portion 36A has an opening 37A from which a projector lamp unit 30 protrudes forwardly of the headlamp, while the side lamp cover portion 36B has an opening 37B in which a side lamp bulb 33 is mounted. The outer surface of the lens holder 24 of the projector lamp unit 20 is formed into a light reflecting surface 24*a*, similarly as in the first embodiment described above. An uneven pattern composed of a number of fisheye-lens-like protrusions 24*d* arranged in matrix form is formed on the front surface of the lamp cover 36 and the outer cylindrical surface of the lens holder 34.

The fourth embodiment has the same effects as the abovedescribed second and third embodiments, and furthermore has an effect that the headlamp 10 and the side lamp are well integrated with one another.

As is apparent from the above description, in the automobile headlamp according to the invention, a part of the lens holder of the projector lamp unit which protrudes forwardly from the opening formed in the lamp cover reflects external light, whereby the gap between the periphery of the opening in the lamp cover the projector lamp unit is not noticeable. Furthermore, the lens holder of the projector lens protrudes forward of the light reflecting surface of the lamp cover, whereby the headlamp looks deeper and more threedimensional. Thus, the projector-type headlamp according to the invention is attractive in external appearance.

What is claimed is:

1. An automobile headlamp comprising:

a lamp body having a front opening;

a front lens covering said front opening;

a lamp cover disposed in said lamp body, said lamp cover having a front reflecting surface; and a projector lamp unit mounted in said lamp body, said projector lamp unit having a forward end portion extending through an opening in said lamp cover, an outer surface of said forward end portion being a reflecting surface.

2. The automobile headlamp according to claim 1, wherein said projector lamp unit comprises a reflector, a light bulb having a filament disposed at a focus of said reflector, a projection lens disposed on an optical axis of said reflector, and a lens holder surrounding and said projection lens, said lens holder having the shape of a truncated cone, said reflecting surface of said projector lamp unit being on an outer surface of said lens holder.

3. The automobile headlamp according to claim 2, wherein a plurality of cylindrical stripes are formed on said outer surface of said lens holder.

4. The automobile headlamp according to claim 3, wherein said cylindrical stripes extend generally in a direction of said optical axis.

5. The automobile headlamp according to claim 3, wherein said cylindrical stripes extend around said lens holder in a direction perpendicular to said optical axis.

6. The automobile headlamp according to claim 2, further comprising a side lamp disposed in said lamp body, said side lamp comprising a side lamp bulb mounted in a second opening formed in said lamp cover.

7. The automobile headlamp according to claim 6, wherein said reflecting surface of said lamp cover and said outer surface of said lens holder are formed with a plurality of fisheye-like protrusions arranged in matrix form.

* * * * *